US006698391B1

(12) United States Patent
Kemnitz

(10) Patent No.: US 6,698,391 B1
(45) Date of Patent: Mar. 2, 2004

(54) MULTIPART COOLED PISTON FOR A COMBUSTION ENGINE

(75) Inventor: Peter Kemnitz, Leutenbach (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/270,255

(22) Filed: Oct. 11, 2002

(30) Foreign Application Priority Data

Sep. 25, 2002 (DE) ..... 102 44 512

(51) Int. Cl.[7] ..... F02F 3/22
(52) U.S. Cl. ..... 123/193.6
(58) Field of Search ..... 123/193.6; 92/186, 92/222, 216

(56) References Cited

U.S. PATENT DOCUMENTS 4,356,800 A * 11/1982 Moebus ..... 123/193.6
4,581,983 A * 4/1986 Moebus ..... 92/186
4,587,932 A * 5/1986 Moebus ..... 123/193.6
5,086,736 A * 2/1992 Wiemann ..... 123/193.6
6,164,261 A * 12/2000 Kruse ..... 123/193.6
6,182,630 B1 * 2/2001 Zhu et al. ..... 123/193.6

FOREIGN PATENT DOCUMENTS

JP 611 75 255 8/1986
WO WO 00 77379 12/2000

* cited by examiner

*Primary Examiner*—Marguerite McMahon
(74) *Attorney, Agent, or Firm*—Collard & Roe, P.C.

(57) ABSTRACT

A multipart cooled piston for a combustion engine comprises a piston upper part of steel comprising a combustion bowl and a ring wall with ring belt, and a piston lower part comprising a box-shaped piston skirt, pin bosses for receiving the piston pin connecting the piston to the connecting rod, and pin boss supports connected to the piston skirt, an inexpensive manufacture with high form stability and improved cooling system is to be achieved in that a cooling channel formed in the piston upper part has holes spread over its circumference towards the piston crown, with the piston material present between such holes forming supporting ribs that each form sections of an all-round ring rib radially to the longitudinal piston axis (K), in that the piston lower part has an annular and all-round carrier rib connected to the pin boss supports, and in that the piston upper part and the piston lower part are non-detachably connected by means of the ring rib and the carrier rib.

7 Claims, 1 Drawing Sheet

MULTIPART COOLED PISTON FOR A COMBUSTION ENGINE

BACKGROUND OF THE INVENTION

1. Field of the Invention

The invention relates to a multipart cooled piston for a combustion engine with a piston upper part of forged steel, comprising a combustion bowl in the piston crown and a ring wall with ring belt, and with a piston lower part comprising a piston skirt, pin bosses for receiving the piston pin connecting the piston to the connecting rod, and pin boss supports connected to the piston skirt. A cooling channel is formed by both the piston upper part and the piston lower part and is limited in its cross-section by these.

2. The Prior Art

A multipart cooled piston for a combustion engine is known from Japanese Patent No. JP 61175255 A. This piston has at the level of the ring belt of the piston a number of ribs, between which is arranged a thermally insulating plate for minimization of the heat transfer from the combustion chamber bowl to the ring belt.

From WO 00/77379 A1, a further piston for a combustion engine is known which has a wall section with several transverse walls made of thin metal sheet which are radially arranged in order to improve the heat dissipation in the cooling channel.

The above designs are not suitable for improvement of the piston with respect to its stability for high ignition pressures and temperatures as encountered in modern diesel engines.

SUMMARY OF THE INVENTION

It is therefore an object of the present invention to provide a multipart cooled piston which can be manufactured inexpensively with a sufficient form stability and with a cooling system with improved cooling effect.

This object is achieved by a piston having a cooling channel formed in the piston upper part which has holes spread over its circumference towards the piston crown, with the piston material present between such holes forming supporting ribs that each form sections of an all-round annular rib radially to the longitudinal piston axis. A piston lower part has an annular and all-round carrier rib connected to the pin boss supports. The piston upper part and the piston lower part are non-detachably connected to one another by the ring rib and the carrier rib, where the ring wall limiting the cooling channel forms by its wall cross-section a gap with the piston lower part, inside which a sealing element can be disposed.

With a piston manufactured in this way, the cooling channel can be formed closer towards the piston crown or combustion bowl and nevertheless has excellent form stability. In addition, the arrangement of the supporting ribs effects a kind of chamber formation inside the cooling channel, i.e. creates shaker areas, whereby a prolongation of the dwell time of the cooling oil is achieved and hence an improved heat dissipation of the piston areas to be cooled.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
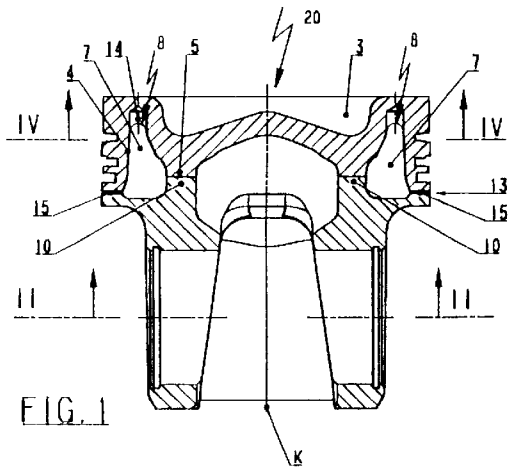
FIG. 1 shows a piston in accordance with the invention, in a cross-section in the pin direction.
Figure 5:
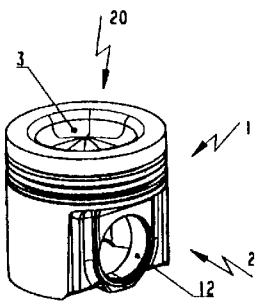
FIG. 5 shows a piston in accordance with the invention in a perspective view.

Referring now in detail to the drawings, FIG. 1 shows the multipart cooled piston 20 in accordance with the invention comprising a forged piston upper part 1 with a combustion bowl 3, ring wall 4 with ring belt 11, and an (upper, towards the piston crown) part of a cooling channel 7, and a piston lower part 2 comprising a (lower, towards the piston skirt 9) part of a cooling channel 7, a piston skirt 9 and pin boss supports 6, as shown in FIG. 5. In accordance with the embodiment, holes 14 are provided in the cooling channel 7 that are arranged symmetrically spread over the circumference and are positioned in the direction of the piston crown, i.e. parallel to the longitudinal piston axis K.

The depth $h_B$ of the holes is not more than half the total height H of the cooling channel 7, so that an unhindered circulation of cooling oil remains assured. Due to this design, shaker areas are created for the cooling oil which increase the cooling effect. In the Figures, the respective oil inlet and outlet are not shown.

Figure 3:
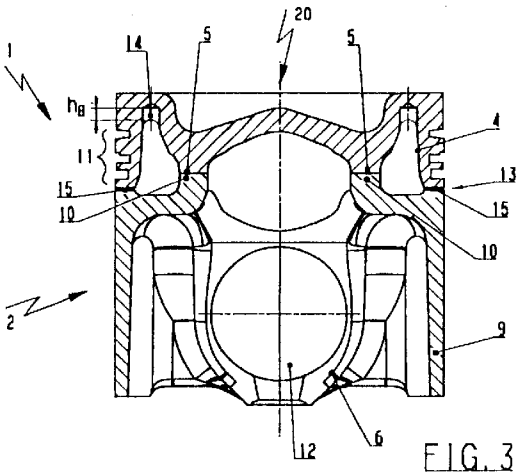
FIG. 3 shows a piston in accordance with the invention, in a cross-section transverse to the piston pin direction.
Figure 2:
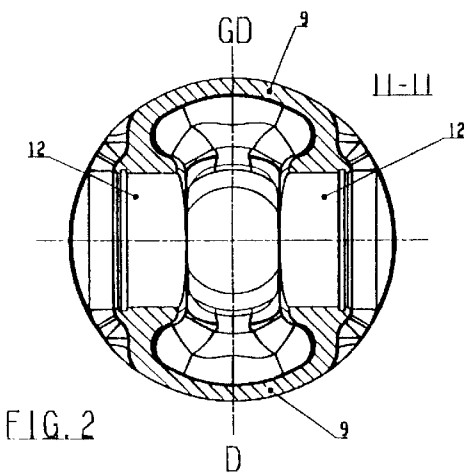
FIG. 2 shows a piston in accordance with the invention from below, in a section along line II of FIG. 1.
Figure 4:
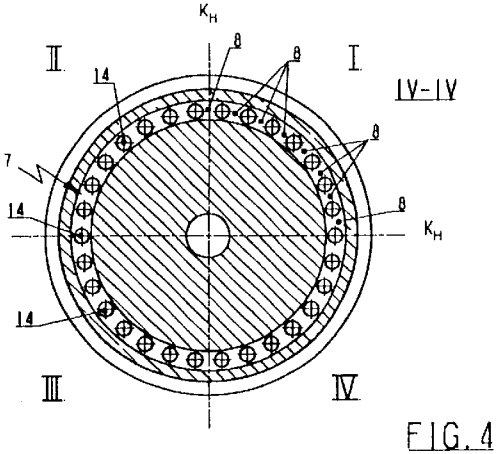
FIG. 4 shows a piston in accordance with the invention, in a section along the line IV—IV of FIG. 1.

As shown in FIGS. 3 and 4, the material areas referred to as supporting ribs 8 between holes 14 merge radially to the longitudinal piston axis K into sections of a ring rib 5, which taken together form the ring rib 5. Holes 14 and hence supporting ribs 8 are, as shown in FIG. 4, arranged radially symmetrically over the circumference of cooling channel 7. In a further embodiment (not shown), the spread can be such that in the major/minor thrust direction D or GD of the piston 20 a larger number of holes 14 and hence of supporting ribs 8 is arranged than transversely thereto, i.e., a non-symmetrical spread in cooling channel 7 is effected on the circumferential side. In this way, the spread of holes 14 and hence of supporting ribs 8 in cooling channel 7 can, if the latter is characterized by the quadrants I–IV formed by the main piston axes $K_H$, be such that within a quadrant a symmetrical (FIG. 6) or non-symmetrical (not shown) spread is achieved, which is reproduced in the opposite quadrants, i.e. I. and III. or II. and IV.

Figure 6:
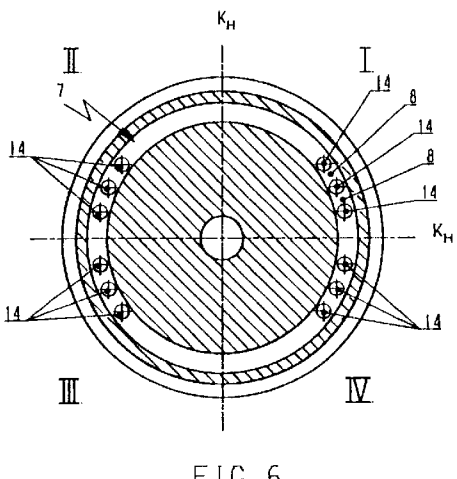
FIG. 6 shows a piston in accordance with the invention, in a section along line IV—IV of FIG. 1, in a further embodiment.

As a result, in the event of loading the temperature and tension strains of the piston 20 can be better countered. The holes 14 can be designed as round holes, as shown in FIGS. 4 and 6, or as elongated holes (not shown) whose long sides face radially outwards from the piston center to the piston wall. With these respective embodiments of the hole arrangements, the holes have different spacings and hence the material designed as supporting ribs 8 is increased. For further influence on the heat dissipation from the combustion bowl 3, the ends of holes 14 can be round or, as shown in FIG. 1, angular.

The axes of holes 14 can, as shown in FIG. 1, be arranged parallel to the longitudinal piston axis K and/or, i.e. in combination, at an acute angle thereto, with the holes 14 pointing in the direction of the combustion bowl 3.

An annular and all-round carrier rib 10 is formed from the pin boss supports 6, as shown in FIG. 3, and corresponds in its geometrical dimensions to the ring rib 5. The piston upper part 1 and piston lower part 2 are non-detachably connected by means of a welding or soldering process using carrier rib 10 and ring rib 5, with finish-machining of the piston 20 into a piston usable in an engine then being performed using metal-cutting methods. The piston upper part 1 advantageously comprises an oxidation-resistant and/or heat-resistant material and the piston lower part 2 a precipitation-hardening ferritic-perlitic steel or tempered steel.

In the connected state of piston upper part 1 and lower part 2, the outer piston wall areas between the two piston parts 1 and 2 form a contact surface which is characterized by a gap 13 a few tenths of a millimeter wide. This can remain open or be sealed by means of a temperature-resistant ring seal positioned on one of the contact surfaces, for example that of the piston lower part 2, before the joining of the two piston parts 1 and 2.

Accordingly, while only a few embodiments of the present invention have been shown and described, it is obvious that many changes and modifications may be made thereunto without departing from the spirit and scope of the invention.

What is claimed is:

1. A multipart cooled piston for a combustion engine, comprising:

a piston upper part of forged steel comprising a combustion bowl in a piston crown and a ring wall with a ring belt:

a piston lower part comprising a piston skirt, pin bosses for receiving a piston pin connecting the piston to a connecting rod, and pin boss supports connected to the piston skirt; and a cooling channel formed by both the piston upper part and the piston lower part and being limited thereby in cross-section, wherein:

the cooling channel formed in the piston upper part has holes spread over a circumference of the cooling channel towards the piston crown, with piston material present between said holes forming supporting ribs such that each supporting rib forms sections of an all-round ring rib radially to a longitudinal piston axis (K), the piston lower part has an annular and all-round carrier rib connected to the pin boss supports, and the piston upper part and the piston lower part are non-detachably connected by the ring rib and the carrier rib, where the ring wall limiting the cooling channel forms by a wall cross-section a gap with the piston lower part and further comprising a sealing element arranged in said gap.

2. A piston according to claim 1, wherein the holes are arranged radially symmetrically spread over the circumference of the cooling channel.

3. A piston according to claim 1, wherein the holes are of a depth ($h_B$) which is no more than half a total height (H) or the cooling channel.

4. Piston according to claim 1, wherein the hole have axes and wherein at least part of the axes of the holes run parallel to the longitudinal piston axis (K).

5. A piston according to claim 4, wherein the holes have a cylindrical form.

6. A piston according to claim 1, wherein the non-detachable connection of the piston upper and lower parts is a welded or soldered connection.

7. A piston according to claim 1, wherein the piston upper part comprises an oxidation-resistant or heat-resistant material and the piston lower part comprise a precipitation-hardening ferritic-perlitic steel or tempered steel.

* * * * *